US008899221B2

(12) United States Patent
Barnett

(10) Patent No.: US 8,899,221 B2
(45) Date of Patent: Dec. 2, 2014

(54) QUIVER APPARATUS FOR CROSSBOWS AND BOWS

(71) Applicant: Barnett Outdoors, LLC, Tarpon Springs, FL (US)

(72) Inventor: David A. Barnett, Tarpon Springs, FL (US)

(73) Assignee: Barnett Outdoors, LLC, Tarpon Springs, FL (US)

( * ) Notice: Subject to any disclaimer, the term of this patent is extended or adjusted under 35 U.S.C. 154(b) by 46 days.

(21) Appl. No.: 13/733,633

(22) Filed: Jan. 3, 2013

(65) Prior Publication Data

US 2014/0182572 A1 Jul. 3, 2014

(51) Int. Cl.
*F41B 5/06* (2006.01)

(52) U.S. Cl.
CPC ..... *F41B 5/066* (2013.01); *Y10S 224/916* (2013.01)
USPC ..... 124/86; 224/916

(58) Field of Classification Search
USPC ..... 124/25, 25.5, 25.7, 86; 224/916
See application file for complete search history.

(56) References Cited

U.S. PATENT DOCUMENTS

| | | | | |
|---|---|---|---|---|
| 3,696,978 | A * | 10/1972 | Gentellalli | 206/315.11 |
| 4,805,584 | A * | 2/1989 | Stinson | 124/86 |
| 5,775,313 | A | 7/1998 | Bresette et al. | |
| 6,763,817 | B2 * | 7/2004 | Nickell | 124/25 |
| 7,077,119 | B1 * | 7/2006 | Dube et al. | 124/86 |
| 7,367,331 | B1 * | 5/2008 | Horinek | 124/86 |
| 7,942,141 | B1 * | 5/2011 | Love et al. | 124/86 |
| 8,061,341 | B2 * | 11/2011 | Hudkins | 124/44.5 |
| 2006/0112945 | A1 * | 6/2006 | Rager | 124/86 |
| 2012/0125307 | A1 | 5/2012 | Bromley et al. | |

* cited by examiner

*Primary Examiner* — John Ricci
(74) *Attorney, Agent, or Firm* — Jones Walker LLP

(57) ABSTRACT

An apparatus for crossbows. The crossbow has a stock attached to a bow and the bolt has an arrowhead attached to a shaft. The apparatus includes an arrowhead bracket attached to the stock, the arrowhead bracket having a first arm containing a first receptacle and a second arm containing a second receptacle. The apparatus may include a hood operatively attached to a cap, the hood being operatively configured to receive the arrowhead. The hood may be engagable with the first or second receptacle. The apparatus may contain a brace positioned on one side of the stock and having a first leg pivotally attached to a second leg and wherein said first leg is configured to engage the shaft of the bolt. The apparatus may also include a selective attachment member that will selectively attach the first and second leg together when the legs are pivoted together.

23 Claims, 8 Drawing Sheets

QUIVER APPARATUS FOR CROSSBOWS AND BOWS

BACKGROUND OF THE INVENTION

This invention relates to an a quiver apparatus for bows. More specifically, but without limitation, the invention relates to an a quiver apparatus used with a crossbow and a bow.

Prior art crossbows have been used by men and women for centuries. Crossbows have proven very useful for hunting as well as for offensive and defense weapons. The popularity and use of crossbows for hunting wild game has increased significantly over the years. An issue with crossbows is the storage of arrows. As readily understood by those of ordinary skill in the art, with most prior art designs, the stock of the crossbow can hold only a single arrows. Quivers have been used over the years as a means for the archer to store arrows. However, prior art quivers suffer from certain disadvantages including ease of use, bulkiness, and obstruction of the line of vision of the archer. Also, the covering of the arrowhead is an important issue that is not adequately addressed by the prior art.

SUMMARY OF THE INVENTION

A quiver apparatus for storing arrows used with a crossbow is disclosed. The crossbow includes a stock attached to a bow and the arrows includes an arrowhead attached to a shaft. In one embodiment, the apparatus comprises an arrowhead bracket attached to the stock of the crossbow, with the arrowhead bracket having a first arm and a second arm, wherein the first arm contains a first receptacle and the second arm contains a second receptacle and a third receptacle. The apparatus may further a first hood attached to a first cap, with the first hood being configured to receive the arrowhead of the arrow, wherein the first hood being engaged with the first receptacle; a second hood attached to a second cap, the second hood configured to receive the arrowhead of the arrow, wherein the second hood is engaged with the second receptacle; a third hood attached to a third cap, the third hood configured to receive the arrowhead of the arrow, wherein the third hood being engaged with the third receptacle; a first brace having a first leg pivotally attached to a second leg, wherein the first leg is configured to engage the shaft of the arrow; and a second brace having a first leg pivotally attached to a second leg, wherein the first leg is configured to engage the shaft of the arrow.

In this embodiment, the apparatus further comprises means for selectively securing the first, second and third caps to the first, second and third hoods. Also, the selectively securing means may comprise the hood having a member with outer threads, and an inner thread member configured on the inner cap so that the inner thread member engages the outer threads of the member. Also, the first brace may contain a locking member configured to lock the first second leg in a perpendicular position. In one embodiment, the apparatus may also include means for selectively attaching the first and second leg when the first and second leg are pivoted together. In one embodiment, the first and second legs comprises a metal alloy and wherein the selectively attaching means comprises a magnet fixed to the second leg so that when the first and second leg are pivoted together, the magnet attaches the first leg to the second leg. Additionally, in one embodiment, the arrowhead bracket is laterally interchangeable relative to the stock so that the first arm and the second arm of the arrowhead bracket may be positioned on either side of the stock.

In another embodiment, an apparatus for storing arrows used with a crossbow is disclosed. The crossbow has a stock attached to a bow, and the arrow has an arrowhead attached to a shaft. In this embodiment, the apparatus comprises a bracket operatively attached to the stock, the bracket having a first arm containing a first receptacle; a first hood operatively attached to a first cap, the first hood being operatively configured to receive the arrowhead of the bolt, wherein the first hood is engaged with the first receptacle; a first brace having a first arm pivotally attached to a second leg and wherein the first leg is configured to engage the shaft of the arrow; and means for selectively attaching the first and second leg when the first and second leg are pivoted together. In one embodiment, the first and second leg includes a metal alloy and wherein the selectively attaching means comprises a magnet fixed to the second leg so that when the first leg and the second leg are pivotally together, the magnet attaches the first leg to the second leg.

In yet another embodiment, an apparatus for use with a crossbow is disclosed. The crossbow contains a stock operatively attached to a bow and the bolt contains an arrowhead attached to a shaft. The apparatus includes an arrowhead bracket operatively attached to the stock, the arrowhead bracket having a first arm containing a first receptacle and a second arm containing a second receptacle, wherein the arrowhead bracket is laterally interchangeable so that the first and the second arm of the arrowhead bracket may be positioned on either the right side or the left side of the stock; a hood operatively attached to a first cap, wherein the hood is engaged with the first receptacle, and wherein the hood is a first half cover pivotally connected to a second half cover, and wherein as the first half cover and the second half cover are pivoted together, the arrowhead is covered. The apparatus may also contain a first brace positioned on the right side of the stock and having a first arm pivot attached to a second leg and wherein the first leg is configured to engage the shaft of the bolt; a second brace positioned on the left side of the stock and having a first leg pivotally attached to a second leg, wherein the first leg is configured to engage the arrow shaft; and means for selectively attaching the first and second leg when the first and second leg are pivoted together. In this embodiment, the first and second leg may include a metal alloy and wherein the selectively attaching means comprises a magnet fixed to the second leg so that when the first leg and the second leg are pivotally together, the magnet attaches the first leg to the second leg.

In yet another embodiment, an apparatus for storing arrows for use with a crossbow is disclosed. The apparatus comprises a bracket operatively attached to the stock, with the bracket having a first arm containing a first receptacle and a second arm containing a second receptacle, wherein the bracket is laterally interchangeable so that the first and second arm may be positioned on either the right side or the left side of the stock. The apparatus also comprises a removable hood operatively attached to a cap, wherein the hood is engaged with the first receptacle; a first brace positioned on the right side of the stock and having a first leg pivotally attached to a second leg so that the first and second leg pivot from a perpendicular position to a closed position, and wherein the first leg is configured to engage the shaft of the arrow; a second brace positioned on the left side of the stock and having a first leg pivotally attached to a second leg so that the first and second leg pivot from a perpendicular position to a closed position, and wherein the first leg is configured to engage the arrow shaft; and, means for selectively attaching the first and second leg when the first and second leg are pivoted together. The removable hood may comprise a first half cover pivotally connected to a second half cover, and wherein as the first half cover and the second half cover are pivoted together, the arrowhead is covered.

Also disclosed is an apparatus for covering an arrowhead of an arrow. In this embodiment, the apparatus comprises a hood operatively attached to a cap, wherein the hood comprises a first half cover pivotally connected to a second half cover, and wherein as the first half cover and the second half cover are pivoted together, the arrowhead is covered. In one embodiment, the second half cover pivots in a downward direction relative to the first half cover, and wherein the first half cover is attached to the cap. Additionally, the first half cover may include a member with an outer thread, and the cap includes an inner thread configured on an inner portion of the cap so that the inner thread engages the outer thread.

DETAILED DESCRIPTION OF THE PREFERRED EMBODIMENTS

Figure 1A:
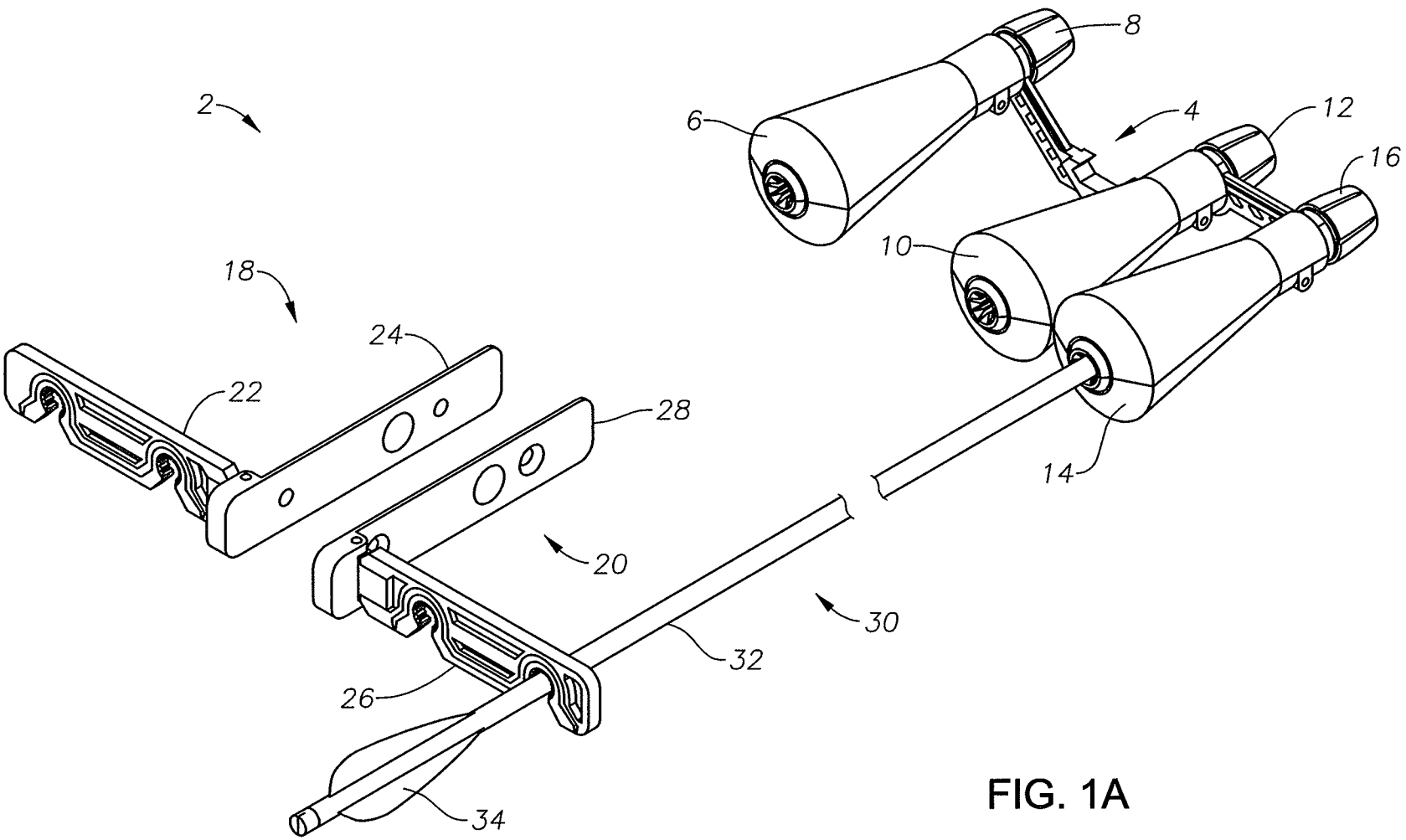
FIG. 1A is a perspective view of components of one embodiment of the apparatus.

Referring now to FIG. 1A, a perspective view of components of one embodiment of the apparatus 2 will now be described. In one embodiment, the apparatus 2 includes the arrowhead bracket 4, the hood 6 with attached cap 8, hood 10 and attached cap 12, and hood 14 and attached cap 16. The embodiment shown in FIG. 1A also includes the brace 18 and the brace 20. The brace 18 contains a first leg 22 and a pivotally attached second leg 24; the brace 20 contains the first leg 26 and a pivotally attached second leg 28. A arrow 30 is also depicted, with the arrow having at one end a arrowhead (not shown in this view), and shaft 32 and feather keel 34.

Figure 1B:
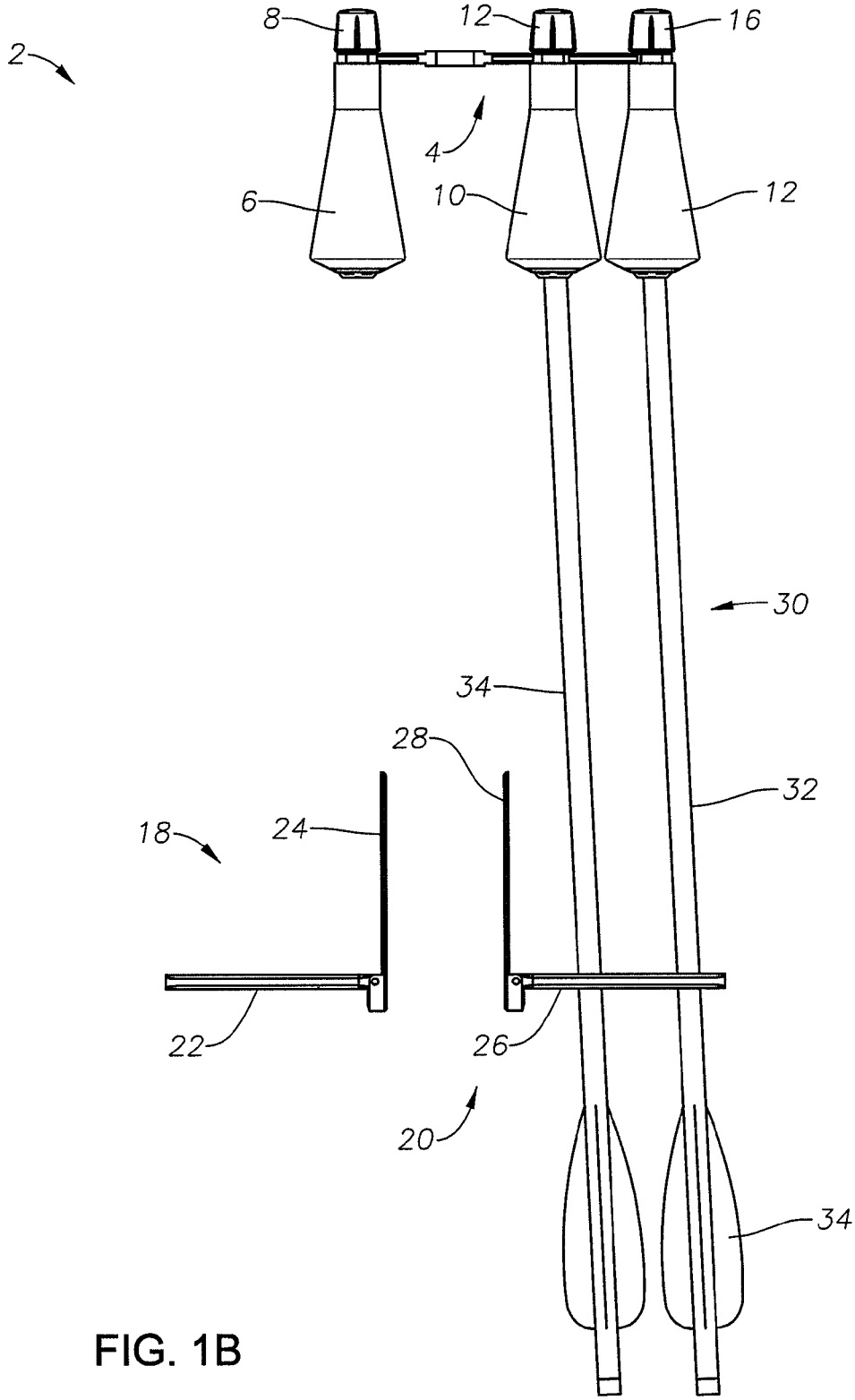
FIG. 1B is a top view of the components of the embodiment depicted in FIG. 1A.

FIG. 1B is a top view of the components of the embodiment depicted in FIG. 1A. It should be noted that like numbers appearing in the various figures refer to like components. The bracket 4 has the hood 6, hood 10, and hood 14 attached thereto. In the embodiment shown in FIGS. 1A and 1B, a total of three arrows can be employed: a first arrow (not shown here) associated with the hood 6, a second arrow 34 associated with hood 10, and a third arrow 32 associated with hood 16.

Figure 2A:
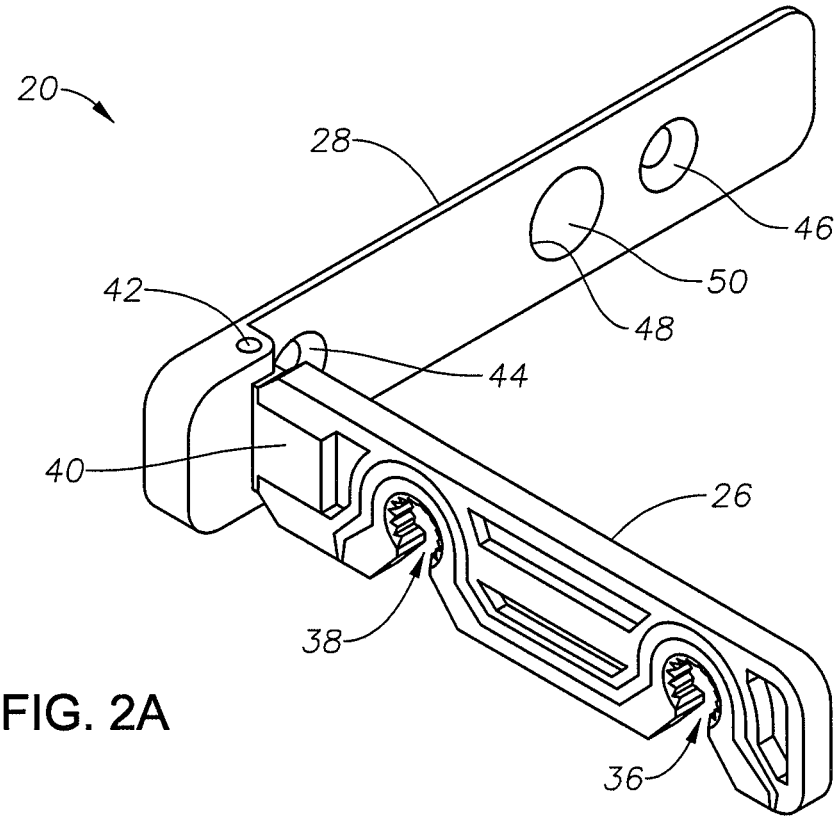
FIG. 2A is a perspective view of one embodiment of the brace component seen in FIG. 1A.

FIG. 2A is a perspective view of one embodiment of the brace 20 seen in FIG. 1A. The leg 26 has a first slot 36 for receiving and grasping the shaft of the arrow, and a second slot 38 for receiving and grasping the shaft of the arrow. As can be seen in FIG. 2A, an end 40 of leg 26 is pivotally attached to the leg 28 at the pivot point hinge pin 42. The brace 20 will also contain a lock 43 to lock the legs 26, 28 in a perpendicular position. The lock 43 may be a latch mechanism. The leg 28 will contain the openings 44, 46 for attaching to the stock of the crossbow (not seen here) with, for instance, a rivet. Also provided is an opening 48 for placement of a magnet 50, wherein when the legs 26, 28 are pivoted together, the magnet 50 will attach (i.e. magnetically hold) the legs 26, 28 together. It should be noted that the legs 26, 28 may be constructed of a metal alloy. Alternatively, the legs 26, 28 may be a composite material and would include a metal alloy portion for cooperation and engagement with the magnet 50. Other attaching means may be used such as snap means for snapping the legs together.

Figure 2B:
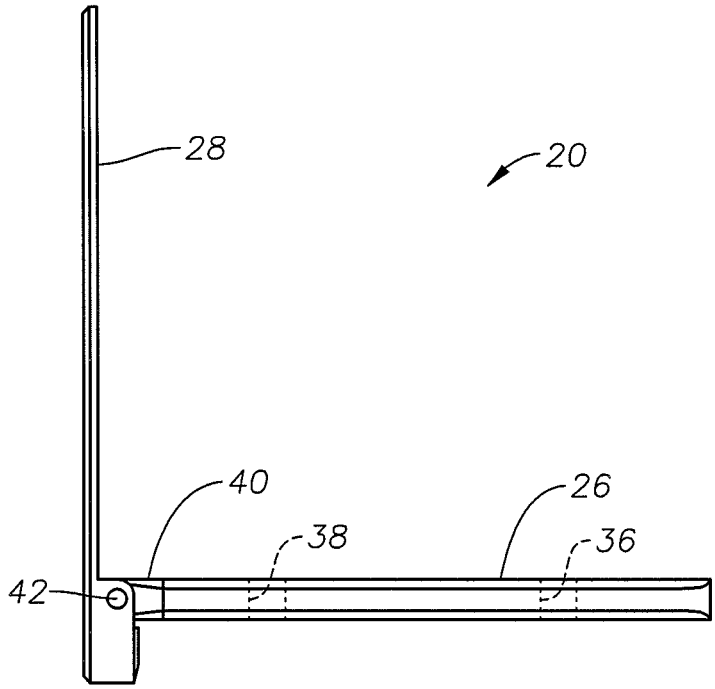
FIG. 2B is a top view of the brace component seen in FIG. 2A in an open position.
Figure 2C:
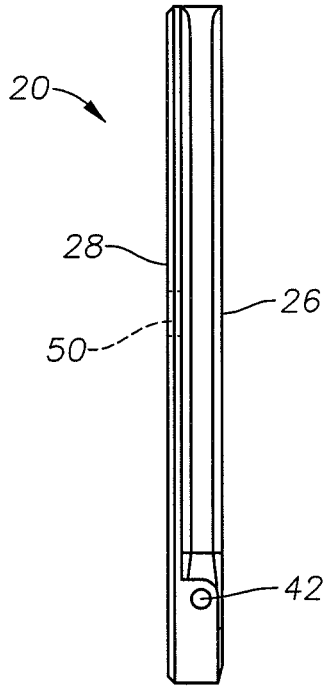
FIG. 2C is a top view of the brace component seen in FIG. 2B in a closed position.

Referring now to FIG. 2B, a top view of the brace 20 of FIGS. 2A and 2B is seen in an open position. Hence, the legs 26 are shown, the slots 36, 38 are shown as well as the pivot point hinge pin 42. FIG. 2C is a top view of the brace component seen in FIG. 2B in a closed position. Hence, the legs 28, 26 have been pivoted closed and the legs 26, 28 are locked into this closed position via the magnet 50.

Figure 3A:
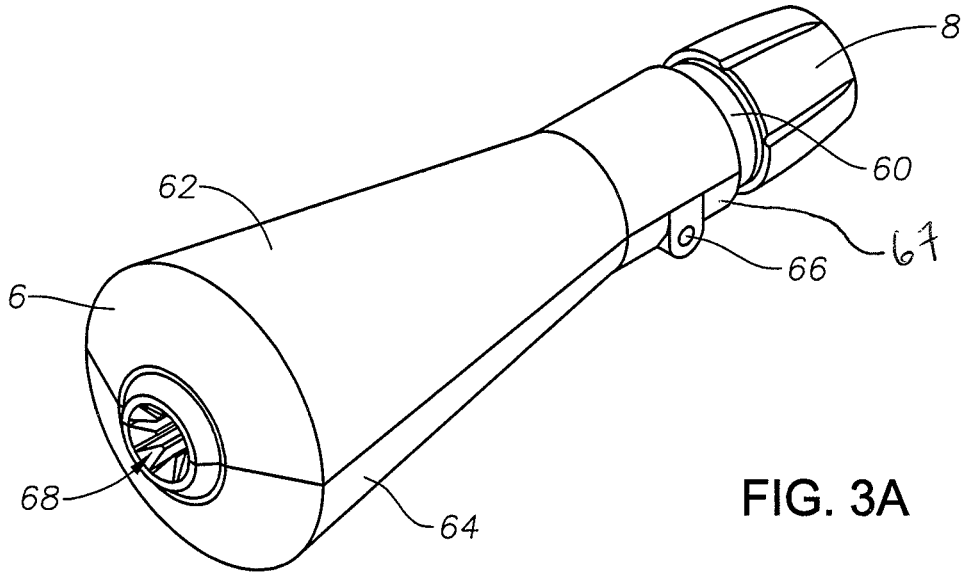
FIG. 3A is a perspective view of the hood and cap component seen in FIG. 1A.

FIG. 3A is a perspective view of the hood 6 seen in FIG. 1A. In one embodiment, the hood 6 is attached to the cap 8 by thread means as will be more fully described below. An indentation 60 is formed between the cap 8 and hood 6, wherein the indentation 60 will cooperate and engage with the bracket 4 seen in FIG. 1A. The indentation 60 is formed when the cap 8 is attached to the hood 6 as see in FIG. 3A. The hood 6 has two half covers, namely half cover 62 and half cover 64. As seen in FIG. 3A, the hood 6 is in the closed position and will cover the arrowhead of the arrow. The half cover 62 and half cover 64 are attached at the pivot point hinge 66. The half cover 62 includes a hinge housing 67 that is operatively configured to receive the pivot point hinge 66. The pivot point hinge 66 is fitted through the hinge housing 67 and the half cover 64, and therefore, the half cover 64 can swing open and closed while the half cover is stationary and attached to the cap 8. When the half cover 62 and half cover 64 are in the closed position, an opening 68 is formed so that the shaft of the arrow extends therefrom.

Figure 3B:
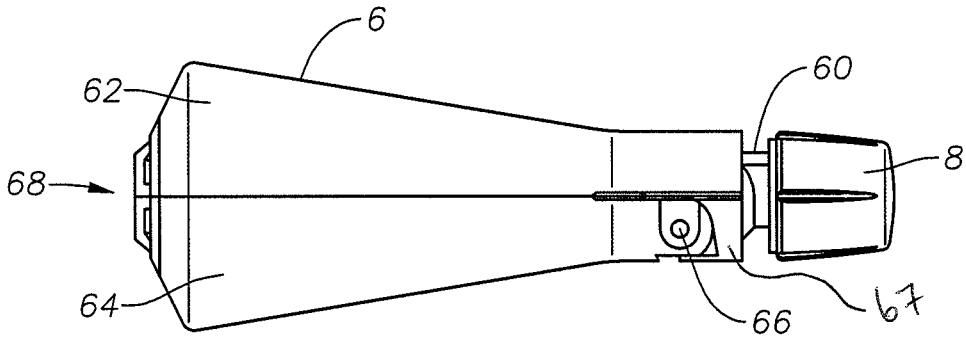
FIG. 3B is a side view of the hood and cap component seen in FIG. 3A.
Figure 3C:
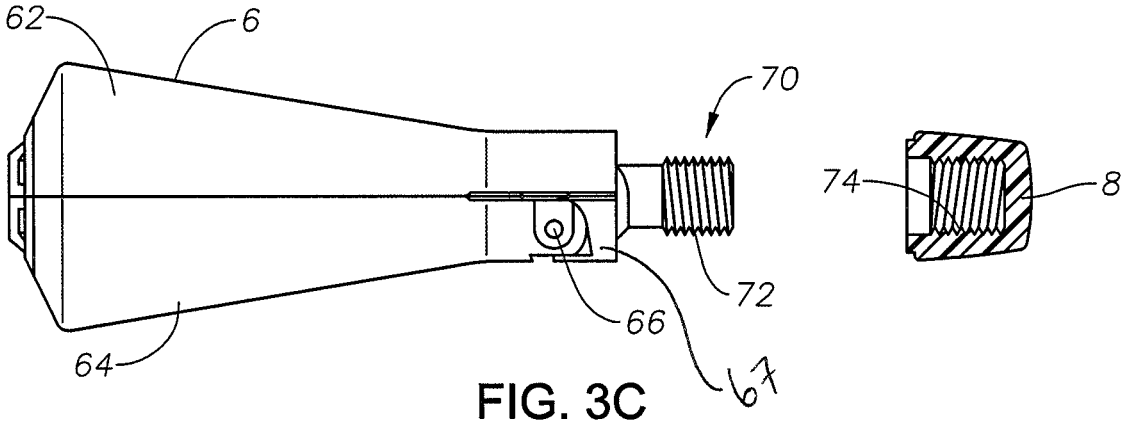
FIG. 3C is a side view of the hood and cap component seen in FIG. 3B, with the cap disengaged from the hood, and the cap shown in a cross-sectional view.
Figure 3D:
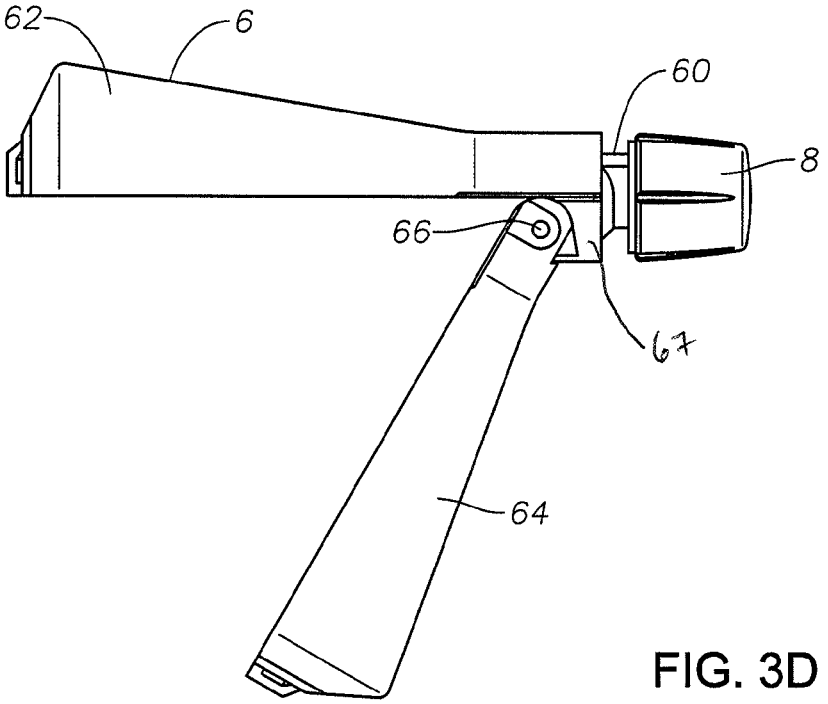
FIG. 3D is a the side view of the hood component seen in FIG. 3B with a cover half in the open position.

Referring now to FIG. 3B, a side view of the hood 6 seen in FIG. 3A. This view depicts the indentation 60, half cover 62, half cover 64, pivot point hinge 66 and hinge housing 67. FIG. 3C is a side view of the hood 6 seen FIG. 3B wherein the cap 8 is disengaged with hood 6, and the cap 8 is shown in a cross-sectional view. More specifically, the hood 6 has an outer member 70 that contains an outer thread 72. In the embodiment shown, the member 70 is attached to the cover 62. The cap 8 has an inner thread 74 and wherein the inner thread 74 will cooperate and engage the outer thread 72 to attached the cap 8 to the hood 6. The hood of the present disclosure allows the archer to attach and/or detach quickly from the bracket 4 by unscrewing the cap 8. FIG. 3D is a side view of the hood 6 seen in FIG. 3B with the half cover 64 in the open position. In other words, the half cover 64 has been pivoted open relative to the half cover 62 via the pivot point hinge 66. The pivot point hinge 66 is positioned through the hinge housing 67. The half cover 62 and cap 8 remains fixed to the bracket 4, and the half cover 64 is pivoted downward to open the hood about the pivot point hinge 66, as seen in FIG. 3D. Note that in use with a crossbow and apparatus 2, the half cover 64 is pivoted downward relative to the bow, thus away from cables, which prevents them from cutting the cables with the broadhead. With the hood 6 in this position, the arrowhead can either be inserted into the cavity or taken out of the cavity. The hood 6 is removable from the arrowhead bracket, and therefore, the archer can remove the arrow from the bracket with the hood still covering the arrowhead. The arrow (with hood 6 covering the arrowhead) can be stored in a storage container for later use by the archer.

Figure 3E:
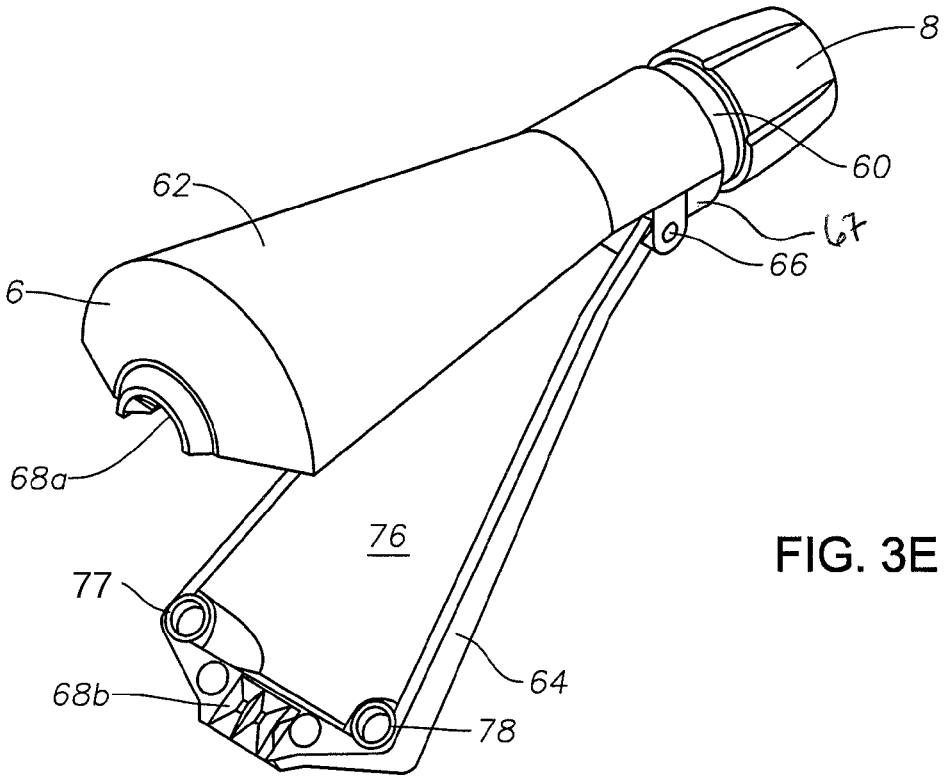
FIG. 3E is a perspective view of the hood component seen in FIG. 3D.

FIG. 3E is a perspective view of the hood 6 and cap 8 seen in FIG. 3D. As depicted in FIG. 3E, the half cover 64 is in the open position. The inner portion of the half cover 64 is denoted by the numeral 76. Hence, when the half cover 62 is engaged (i.e. closed) relative to the half cover 64, a cavity is formed within the cover for the arrowhead. Also shown in FIG. 3E is the half opening 68*a* and the half opening 68*b*, wherein when the cover is closed, the opening 68 is formed. FIG. 3E also depicts the circular protrusions 77 and 78. The protrusions 77, 78 will cooperate and engage with mating indentations (not seen) on the inner portion of the half cover 62 so that the half cover 62 and half cover 64 can be attached (i.e. snapped) together or be pivoted apart. Moreover, the hood herein disclosed, such as seen in FIGS. 3A, 3B, 3C, 3D, and 3E, may be used to cover arrowheads of arrows that are used with other bows, such as compound bows.

Figure 4A:
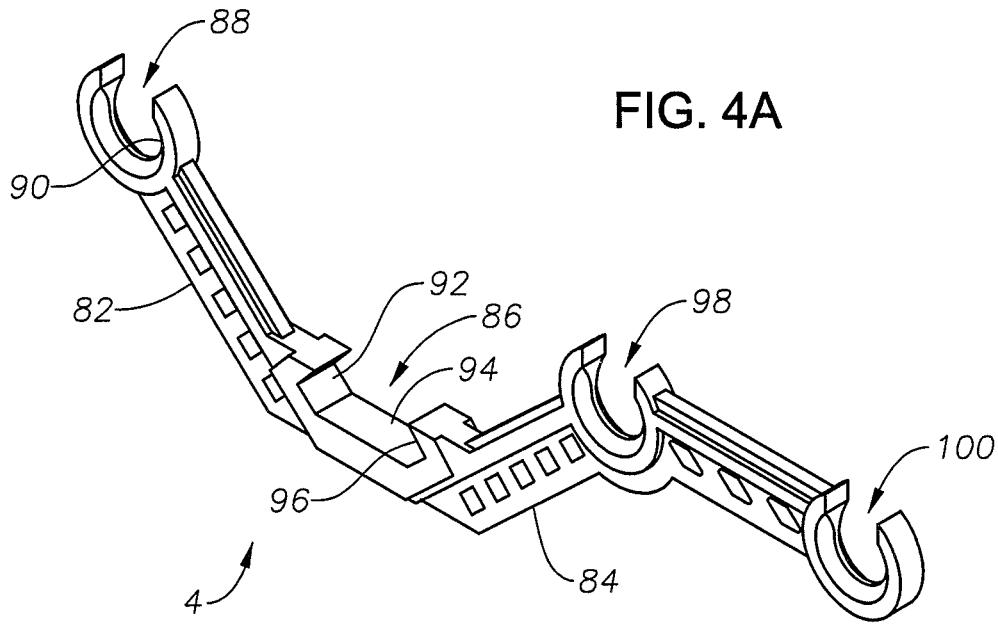
FIG. 4A is a perspective view of the bracket component seen in FIG. 1A.

Referring now to FIG. 4A, a perspective view of the arrowhead bracket 4 seen in FIG. 1A will now be described. The bracket 4 has a first arm 82 and a second arm 84. The bracket also has an attachment member profile 86 for attaching the bracket 4 to the stock of the crossbow (the stock not seen here). The attachment member profile 86 may also be referred to as socket 86. The arm 82 extends at an angle from the attachment member profile 86, wherein at the terminal end of arm 82 is a receptacle 88 for cooperation and engagement with the indentation 60 of the hood 6. In other words, the indentation 60 will snap into the receptacle 88. The body of the receptacle 88 is generally circular 90 with an opening for the indentation 60 to fit there through. The attachment member 86 comprises a V-shaped side 92 that extends to a flat surface side 94 which in turn extends to another V-shaped side 96, wherein the sides 92, 94 and 96 forms an attachment profile that will cooperate and engage with a receptacle profile of the stock of the crossbow (not seen here). The second arm 84 extends from the attachment member profile 86 at a first angle to the receptacle 98, which is similar in construction to receptacle 88, and wherein receptacle 88 will cooperate and engage with an indentation 60 of the hood 6. Extending from the receptacle 98 is a second part of the arm 84, and wherein the terminal part of the arm 84 is the receptacle 100, which is similar in construction to receptacle 88, and wherein the receptacle 100 will cooperate and engage with the indentation 60.

Figure 4B:
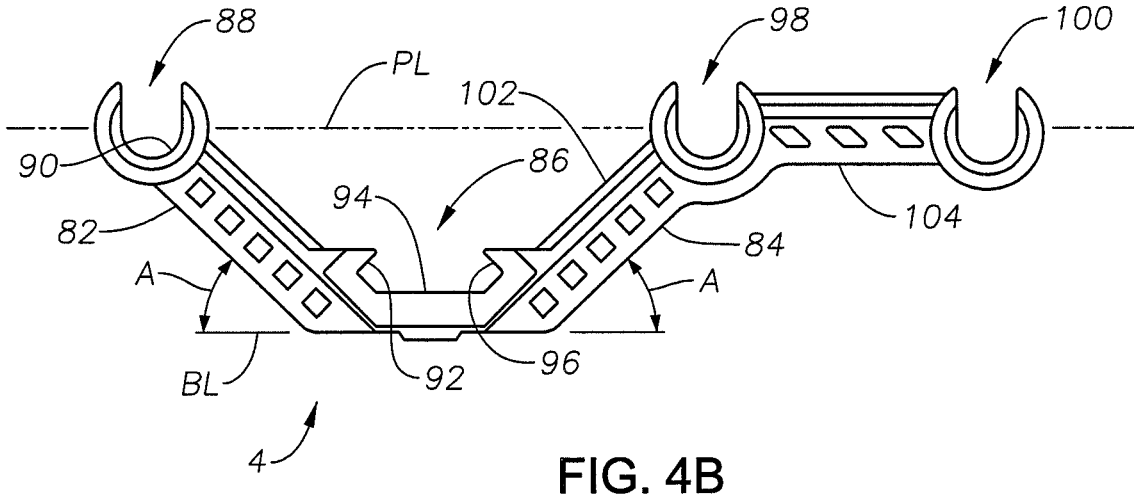
FIG. 4B is a plan view of the bracket component seen in FIG. 4A.

FIG. 4B is a plan view of the bracket 4 seen in FIG. 4A. The arm 82 extends from a base line BL of the attachment member profile 86 at an angle A, in one embodiment, of 45 degrees. The arm 84 comprises two segments, namely segment 102 and segment 104, wherein segment 102 is at an angle A of 45 degrees. The segment 104 extends from the segment 102, wherein the segment 104 extends parallel with the base line BL of the attachment member 86. Hence, the receptacles 88, 98 and 100 are configured along the same plane line PL.

Figure 5A:
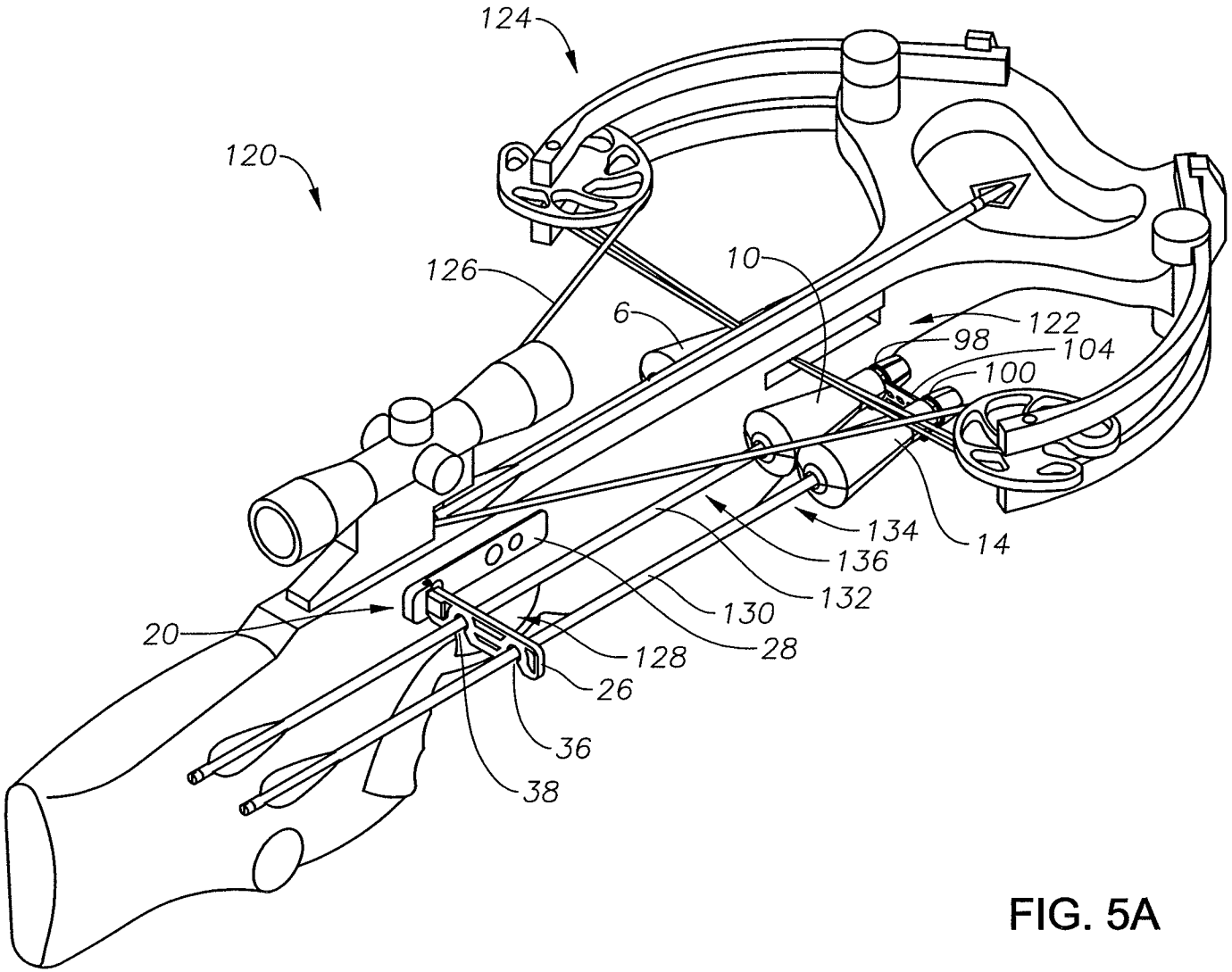
FIG. 5A is a perspective view of one embodiment of the apparatus mounted to a crossbow.

FIG. 5A is a perspective view of one embodiment of the apparatus mounted to a crossbow 120. Crossbows are commercially available from Barnett Crossbows Inc. under the name Ghost which can be found on the internet at www.barnettcrossbows.com, wherein the website is incorporated herein by express reference. The crossbow 120 includes the stock, depicted at 122, along with the bow 124. The crossbow 120 includes the bow string 126 that is shown in the cocked position in FIG. 5A, and the trigger mechanism 128. FIG. 5A depicts the brace 20 attached to the stock 122, and more specifically, the leg 28 being attached to the stock 122 with a rivet member. As shown in FIG. 5A, the leg 26 is extending outward and the leg 26 is positioned to engage the shafts 130, 132 of the arrow 134, 136 respectively. Note that the arrow on the left side of the crossbow 120 is not seen in this view. Hence, in this embodiment, a total of three arrows are stored, including bolts 134, 136 on the right side of the crossbow 120 and one arrow on the left side of the crossbow 120. The hoods 6, 10 and 14 (along with the indentations and caps) are also depicted cooperating and engaged with the arrowhead bracket 4 as previously described. More specifically, the hoods 6, 10 and 14 will cooperate and engage within the receptacles 88, 98, 100 (wherein the receptacles 98, 100 are contained on the segment 104 and receptacle 88 is contained on leg 82, which are not seen in this view).

According to the teachings of this disclosure, the archer can include only two arrows on the right side, and none on the left, or one bolt on the right and one on the left, or two on the left and no arrows on the right. When no arrows are being used on one side, the leg 22 of the brace 18 or leg 26 of the brace 20 can be folded in with the hinged leg and locked closed. In this way, the archer can clear his/her line of sight as well as freeing the space as desired.

Figure 5B:
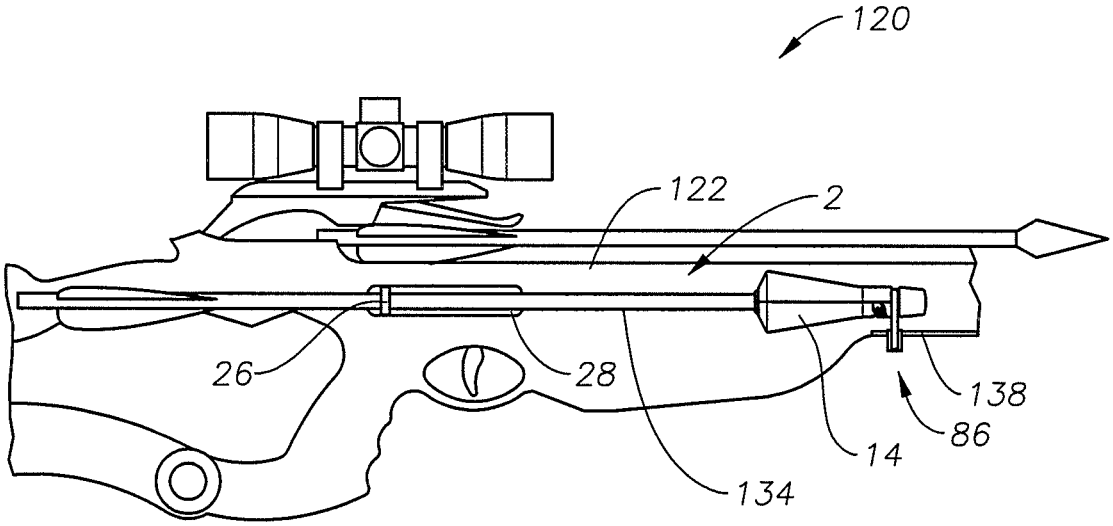
FIG. 5B is a plan view of the apparatus mounted to the crossbow seen in FIG. 5A.

Referring now to FIG. 5B, a plan view of the apparatus 2 mounted to the crossbow 120 seen in FIG. 5A. This view depicts the right side of the crossbow 120 and shows the arrow 134. The leg 28 (affixed to the stock 122) and the leg 26 are shown. Note also that the attachment member 86 is shown, wherein the attachment member 86 will attach to the underside of the stock 122 in a reciprocal mating member 138. FIG. 5B also shows the hood 14 which is covering the arrowhead.

Figure 5C:
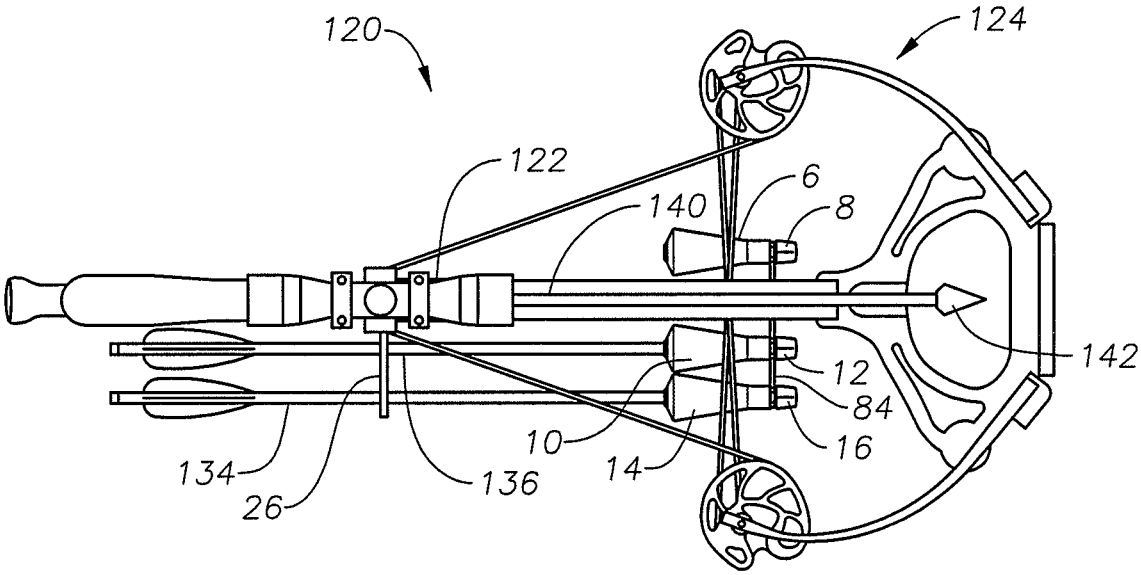
FIG. 5C is a top view of the apparatus mounted to the crossbow seen in FIG. 5A.

FIG. 5C is a top view of the apparatus, seen generally at 2, mounted to the crossbow 120 seen in FIGS. 5A and 5B. The hoods 6, 10 and 14 are depicted attached to the caps 8, 12, and 16, respectively. The arrows 134 and 136 are attached to the leg 26 at one end as well as the arm 84 of the arrowhead bracket 4, as previously described. The arrow 140 has been retrieved from the hood 6 and leg 22, and wherein the leg 22 has been folded and locked into place, as previously described. The bolt 140 is placed on the crossbow 120 in a firing position. In other words, the archer will open the hood 6 thereby allowing removal of the arrowhead 142. The archer places the arrow 140 onto the top of the stock 122 (as seen in FIG. 5C) and cocks the bow, as is well understood by those of ordinary skill in the art. After firing the arrow 140, the archer can then remove the bolt 134 from the apparatus, mount and then cock the bolt for firing.

An aspect of one embodiment of the present disclosure is that the legs of the braces pivot open as well as closed; hence, if the archer is not using a brace, the archer can pivot the legs closed thereby reducing the bulkiness as well as improving the archer's line of sight. Another aspect is that the apparatus aids both right handed archers and left handed archers since a pair of arrows may be placed on either the right or left side of the stock. Yet another aspect of one embodiment of the disclosure is the hoods are removable from the bracket. Still yet another aspect is that the hood can follow the arrowhead and arrow. Another aspect is that the individual hoods may be placed on either the right or left side of the stock, or alternatively, on both sides of the stock. Yet another aspect is that the hood provides a cover for the arrowhead when the archer stores the arrow during nonuse. In other words, the archer can remove and store the arrow (with the hood covering the arrowhead) without the arrowhead cutting or tearing the storage area. Also, the arrowhead is protected from damage when covered by the hood. Still yet another aspect is that the hood can be used with arrowheads employed with other bows, such as compound bows.

Although the present invention has been described in considerable detail with reference to certain preferred versions thereof, other versions are possible. Therefore, the spirit and scope of the appended claims should not be limited to the description of the preferred versions contained herein.

I claim:

1. A quiver apparatus for storing bolts used with a crossbow, the crossbow having a stock operatively attached to a bow, and wherein the bolts contain an arrowhead attached to a bolt shaft, the apparatus comprising:

an arrowhead bracket attached to the stock, said arrowhead bracket having a first arm and a second arm, wherein said first arm contains a first receptacle and said second arm contains a second receptacle and a third receptacle;

a first hood attached to a first cap, said first hood being configured to receive the arrowhead, wherein said first hood being engaged with said first receptacle;

a second hood attached to a second cap, said second hood configured to receive the arrowhead, wherein said second hood being engaged with said second receptacle;

a third hood attached to a third cap, said third hood operatively configured to receive the arrowhead, wherein said third hood being engaged with said third receptacle;

a first brace having a first leg pivotally attached to a second leg wherein said first leg is configured to engage the bolt shaft;

a second brace having a first leg pivotally attached to a second leg, wherein said first leg is configured to engage the bolt shaft.

2. The apparatus of claim 1 further comprising means for selectively securing said first, said second, and said third cap to said first, said second and said third hood.

3. The apparatus of claim 2 wherein said selectively securing means comprises a member with an outer thread attached to the hood, and an inner thread configured on the inner cap so that the inner thread engages said outer thread of said member.

4. The apparatus of claim 3 wherein said first brace contains a locking member configured to lock said first leg to said second leg in a perpendicular position.

5. The apparatus of claim 3 further comprising means for selectively attaching said first leg and said second leg when said first leg and said second leg are pivoted together.

6. The apparatus of claim 5 wherein said first leg and said second leg includes a metal alloy and wherein said selectively attaching means comprises a magnet fixed to said second leg so that when said first leg and said second leg are pivoted together, the magnet attaches said first leg to said second leg.

7. The apparatus of claim 6 wherein said arrowhead bracket is laterally interchangeable relative to the stock so that said first arm and said second arm of said arrowhead bracket may be positioned on either side of the stock.

8. An apparatus for storing bolts used with a crossbow, the crossbow having a stock attached to a bow and said bolts having an arrowhead attached to a shaft, the apparatus comprising:

an arrowhead bracket attached to the stock, said arrowhead bracket having a first arm containing a first receptacle and a second arm containing a second receptacle;

a first hood operatively attached to a first cap, said first hood being operatively configured to receive the arrowhead, wherein said first hood being engagable with said first receptacle or second receptacle;

a first brace positioned on the right side of the stock and having a first leg pivotally attached to a second leg and wherein said first leg is configured to engage the shaft of the bolt;

means for selectively attaching said first leg and said second leg when said first leg and said second leg are pivoted together.

9. The apparatus of claim 8 wherein said first leg and said second leg includes a metal alloy and wherein said selectively attaching means comprises a magnet fixed to said second leg so that when said first leg and said second leg are pivotally together, the magnet attaches said first leg to said second leg.

10. The apparatus of claim 9 further comprising a second hood operatively attached to a second cap, said second hood configured to receive the arrowhead, and wherein said a second receptacle receives said second hood.

11. The apparatus of claim 10 further comprising a third hood operatively attached to a third cap, said third hood configured to receive the arrowhead and wherein said arrowhead bracket contains a third receptacle that receives said third hood.

12. The apparatus of claim 11 further comprising a second brace operatively attached to the stock, said second brace having a first leg pivotally attached to a second leg, and wherein said second leg is configured to engage the shaft of the bolt.

13. The apparatus of claim 12 wherein said first hood includes a member with an outer thread, and said first cap includes an inner thread configured on an inner portion of said first cap so that the inner thread engages said outer thread.

14. The apparatus of claim 13 wherein said arrowhead bracket are laterally interchangeable relative to the stock so that said first arm and said second arm of said arrowhead bracket may be positioned on either side of the stock.

15. The apparatus of claim 14 wherein said first brace contains a locking member to lock said first leg and said second leg in a perpendicular position.

16. An apparatus for storing bolts for use with a crossbow, the crossbow having a stock operatively attached to a bow and said bolt having an arrowhead attached to a shaft, the apparatus comprising:

an arrowhead bracket operatively attached to the stock, said arrowhead bracket having a first arm containing a first receptacle and a second arm containing a second receptacle, wherein said arrowhead bracket is laterally interchangeable so that said first arm and said second arm of said arrowhead bracket may be positioned on either the right side or the left side of the stock;

a hood operatively attached to a first cap, wherein said hood is engaged with said first receptacle, and wherein said hood comprises a first half cover pivotally connected to a second half cover, and wherein as the first half cover and the second half cover are pivoted together, the arrowhead is covered;

a first brace positioned on the right side of the stock and having a first leg pivotally attached to a second leg and wherein said first leg is configured to engage the shaft of the bolt;

a second brace positioned on the left side of the stock and having a first leg pivotally attached to a second leg, wherein said first leg is configured to engage the bolt shaft;

means for selectively attaching said first leg and said second leg when said first leg and said second leg are pivoted together.

17. The apparatus of claim 16 wherein said first leg and said second leg includes a metal alloy and wherein said selectively attaching means comprises a magnet fixed to said second leg so that when said first leg and said second leg are pivotally together, the magnet attaches said first leg to said second leg.

18. An apparatus for storing bolts for use with a crossbow, the crossbow having a stock operatively attached to a bow and said bolt having an arrowhead attached to a shaft, the apparatus comprising:

a bracket operatively attached to the stock, said bracket having a first arm containing a first receptacle and a second arm containing a second receptacle, wherein said bracket is laterally interchangeable so that said first arm and said second arm of said bracket may be positioned on either the right side or the left side of the stock;

a removable hood operatively attached to a cap, wherein said hood is engaged with said first receptacle;

a first brace positioned on the right side of the stock and having a first leg pivotally attached to a second leg so that said first leg and said second leg pivot from a perpendicular position to a closed position, and wherein said first leg is configured to engage the shaft of the bolt;

a second brace positioned on the left side of the stock and having a first leg pivotally attached to a second leg so that said first leg and second leg pivot from a perpendicular position to a closed position, and wherein said first leg is configured to engage the bolt shaft;

means for selectively attaching said first leg and said second leg when said first leg and said second leg are pivoted together.

19. The apparatus of claim 18 wherein said removable hood comprises a first half cover pivotally connected to a second half cover, and wherein as the first half cover and the second half cover are pivoted together, the arrowhead is covered.

20. The apparatus of claim 19 wherein said first leg and said second leg comprises a metal alloy and wherein said selectively attaching means comprises a magnet fixed to said second leg so that when said first leg and said second leg are pivotally together, the magnet attaches said first leg to said second leg.

21. An apparatus for covering an arrowhead of an arrow, the apparatus comprising:

a hood operatively attached to a cap, wherein said hood is spaced apart from the cap by an indentation and wherein said hood comprises a first half cover pivotally connected to a second half cover, and wherein as the first half cover and the second half cover are pivoted together, the arrowhead is covered.

22. The apparatus of claim 21 wherein the second half cover pivots in a downward direction relative to said first half cover, and wherein said first half cover is attached to said cap.

23. The apparatus of claim 22 wherein said first half cover includes a member with an outer thread, and said cap includes an inner thread configured on an inner portion of said cap so that the inner thread engages said outer thread.

* * * * *